United States Patent [19]

Davenport

[11] Patent Number: 4,883,317

[45] Date of Patent: Nov. 28, 1989

[54] MULTI-PURPOSE CHAIR

[76] Inventor: Lizzie B. Davenport, RR. 1, P.O. Box 278, Pine Knot, Ky. 42635

[21] Appl. No.: 258,805

[22] Filed: Oct. 17, 1988

[51] Int. Cl.[4] ..... A47C 7/62

[52] U.S. Cl. ..... 297/193; 297/191; 312/235.5

[58] Field of Search ..... 312/235 R, 294, 351, 312/292, 293, 237; 297/190, 191, 192, 193, 188

[56] References Cited

U.S. PATENT DOCUMENTS

| | | | |
|---|---|---|---|
| D. 173,828 | 1/1955 | Ziebell | 297/193 X |
| 534,443 | 2/1895 | Manguine | 297/193 X |
| 593,038 | 11/1897 | White | 297/191 X |
| 879,803 | 2/1908 | Vlasak | 297/191 X |
| 1,832,642 | 11/1931 | Leff | 297/190 X |
| 3,213,467 | 10/1965 | Hubbard | 297/193 X |

FOREIGN PATENT DOCUMENTS

| | | | |
|---|---|---|---|
| 141335 | 5/1951 | Australia | 312/235 R |
| 200016 | 9/1938 | Switzerland | 312/235 R |

*Primary Examiner*—James T. McCall
*Attorney, Agent, or Firm*—Robert A. Spray

[57] ABSTRACT

A chair for a child, having a plurality of storage regions provided in most all the possible places not used for seating, i.e., in the chair base, under the seat, and on the back of the upright chair-back.

The storage features are of various sizes, shapes, and natures; and, all being handy and easily reachable and conveniently to use, the storage of most items of the child or used in the child's care is made easy and convenient, with helpfulness and incentive toward ordiliness, etc.

6 Claims, 1 Drawing Sheet

MULTI-PURPOSE CHAIR

FIELD OF THE INVENTION

The present invention relates to children's furniture, and more particularly relates to children's furniture providing a plural function, i.e., not only a chair seat but also storage facilities for items used by or for a small child.

The provision of storage features with seat-type furniture as a basic concept is itself not a new concept; and indeed as shown below there has been a lengthy development of such multi-purpose articles of furniture. But the present invention achieves a combination of a plurality of storage features, helpful to both the child and the parent, in achieving orderliness of the child-attendance site and helpfulness in training the child as to orderliness.

SUMMARY OF THE INVENTION

In carrying out the invention in a preferred embodiment, the invention provides a child's chair whose seat is pivotally raisable for access to a storage tray. Below the tray there is provided a storage drawer; and on the back of the upright back of the chair there are provided a set of receiver members particularly sized to receive articles such as socks and shoes of the child.

The close proximity of the various storage regions, and their diversity in size and shape, help the adult to encourage the child as to orderlines of the child's things and of articles used in the care of the child.

The invention's components and concepts are similar to those available in the prior art, except for the present concepts in particular:

In a hindsight consideration of the present invention to determine its inventive and novel nature, it is not only conceded but emphasized that the prior art had details usable in this invention but only if the prior art had had the guidance of the present concepts of the present invention.

That is, it is emphasized that the prior art had several particulars which individually and accumulatively show the non-obviousness of this combination invention:

a. The prior art had youth chairs of various types;

b. The prior art knew the advantages of providing handy and convenient storage regions as a general principle;

c. The prior art knew that children have and use a variety of clothing items, toys, etc., which are desirably kept in handy storage places;

d. The prior art knew that youth chairs have an overall shape which accommodates storage concepts in addition to a seat;

e. The prior art is practically unlimited as to persons who would have both the incentive, motivation, and the mechanical know-how to provide this inventive combination if its creativity had been obvious;

f. The prior art knew of the unlimited market potential of youth furniture articles, both as to the number of prospective users but as to the incentive of unlimited numbers of parents to purchase one for their child;

g. The prior art knew of the desire to train children to be orderly, for the sake of the children's upbringing as well as to the assistance it provides for the parent.

The Prior Art has attempted various types of youth or child furniture providing storage regions:

The prior art has tried a variety of types of youth furniture having provisions for article-storage as well as providing a seat for the child; and the existence of such articles embodying features of storage of various kinds is not only conceded, it is emphasized, for as to the novelty here of the invention as considered as a whole, a contrast to the prior art helps show both the dissatisfaction of the various attempts of improvement, and the advantages and the inventive significance of the present concepts. Thus, as shown herein, the inventive significance of the present concepts is emphasized, and the nature of the concepts and their results can perhaps be easier understood.

Even further as indicating the inventive nature of the present concepts is the result of a Preliminary Patentability Search made in the Search files of the U.S. Patent Office, after this invention was made, and during the course of considering the desire and likelihood of patent protection.

The Search produced the following, all U.S. Patents:

| | | |
|---|---|---|
| 210,487 | G. C. Bovey | December 3, 1878 |
| 2,628,879 | M. M. Schultz | February 17, 1953 |
| 2,765,025 | Bakalic et al. | October 2, 1956 |
| 3,592,506 | J. D. Breslow | July 13, 1971 |
| 4,248,476 | M. B. Phelps | February 3, 1981 |
| 4,527,830 | R. A. Meyers | July 9, 1985 |

However, although varieties are shown, none show or suggest details of the overall combination of the present invention, as is the proper and accepted way of considering the inventiveness nature of the concepts.

That is, although the references found on the Search of prior art show an approach to the overall invention, it is significant that none of the several references show the novel and advantageous combination, which provides the merits of this invention, even though certain details are shown separately.

More particularly in this regard, the Search references show a separateness of details as follows:

Bovey, Schultz, Bakalic, and Phelps show chairs with storage drawers under the seat. Also, the Breslow patent shows a child's chair-like furniture device having a storage container carried below the seat; and the Meyers device shows an infant's seat and table device having storage below the seat.

Nevertheless, even though improvements with respect to youth furniture embodying storage regions are within the mechanical ability of all persons the world over, none of these devices, even though they illustrate a variety of attempts of providing multi-purpose youth furniture, they fail to show the overall combination provided by the present invention, in that none of these furniture articles which show a storage drawer below the seat show the fuller concept of an extra storage region provided immediately under a raisable seat, and none show the provision of additional storage bodies on the back of an upright back panel of the furniture.

Accordingly, the various concepts and components are conceded and emphasized to have been widely known in the prior art as to furniture and storage devices, even of youth furniture with various storage regions type; nevertheless, the prior art not having had the particular combination of concepts and details as here presented and shown as a novel combination different from the prior art and its suggestions, even only a fair amount of realistic humility, to avoid consideration of this invention improperly by hindsight, requires the concepts and achievement here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art of all relevant fields.

BRIEF DESCRIPTION OF THE DRAWINGS

The above description of the novel and advantageous invention is of somewhat introductory and generalized form. More particular details, concepts, and features are set forth in the following and more detailed description of illustrative embodiments, taken in conjunction with the accompanying drawings, which are of somewhat schematic and diagrammatic nature, for showing the inventive concepts.

DETAILED DESCRIPTION OF ILLUSTRATIVE EMBODIMENTS

Figures 1, 2:
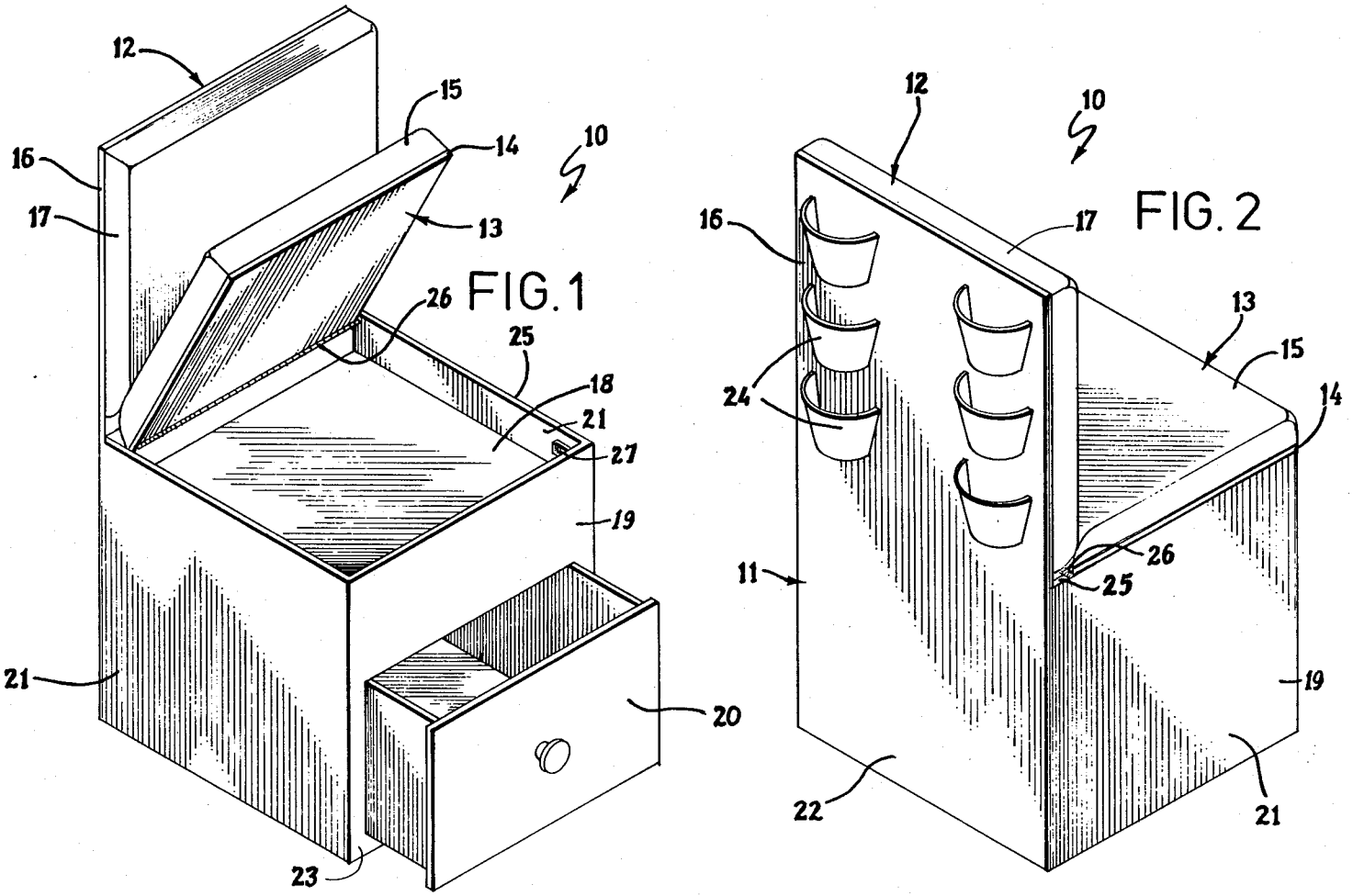
FIG. 1 is a isometric pictorial view of an article of youth furniture according to an embodiment of the invention and illustrating its concepts, this view illustrating the pivotal seat in a semi-raised condition, and showing a storage drawer in a partially open condition, this view in FIG. 1 being shown as taken from the front and side of the article.
FIG. 2 is another isometric pictorial view of an article of youth furniture according to the invention, on the same scale as FIG. 1, and generally like the article in FIG. 1, except that the pivotal seat is shown in lowered or seat-forming position; and this embodiment slightly differs from that in FIG. 1 in that the embodiment of FIG. 2 shows that the hinge for the seat is above the top edge of the furniture's side panel, and the seat in this embodiment of FIG. 2 rests upon that top side panel edge when the seat is lowered into a seat-forming position.

As shown in the drawings, the children's chair 10 is a furniture article which advantageously provides a multiplicity of storage functions in addition to providing a seat.

Thus the chair 10 provides not only the advantage of a seat for the child, but it provides storage features of convenience to both the child and the parent, and provides such convenience and handiness of storage that the parent can advantageously use it as a device helpful in the training of the child to be orderly.

The chair 10 includes a back panel 11 which has a integral extension 12 which extends above the seat 13 to provide a supportive back for the child as he or she may be sitting on the seat 13.

The seat 13 is shown as having a support panel 14, on top of which is provided a seat pad 15.

Similarly, the upright seat back 12 is shown as provided with a rigid panel-like frame member 16, and on the front of the panel 16 there is carried a back pad 17.

One of the features of the storage, which is provided by the chair 10, is a tray 18 which is carried by the chair base 19 below the seat 13; and thus between the tray 18 and the seat 13 there is a storage region of what might be called a first type.

The chair base 19 also is shown as provided with a drawer 20, the top of which is sufficiently below the elevation of the tray 18 as to avoid interference; and the drawer provides article-storage of what might be called a second type.

The sides 21 of the base 19 are shown as of panel-like nature, and they extend from the lower portion 22 of the chair back 11 forward to the front face panel 23 of the chair base 19; and the front base panel 23 is appropriately cut to accommodate the drawer 20 as it slides in and out.

An article-storage means 24, of which might be referred to as a third type, is shown by a set of receiver members 24, shown as upwardly open pocket nature, suitably affixed to the back panel 16. These receivers 24 are quite suitable for socks and shoes of the child.

The chair seat 13, in the embodiment of FIG. 2, is shown as resting on the upper edge 25 of the chair's side panels 21; and a hinge member 26 is shown as pivotably connecting the chair seat 13 and the support base 19, thus providing that the seat 13 may be pivoted or rotated upwardly for access to the article-storage tray region 18.

A seat-support block 27, in the embodiment of FIG. 1, is shown as attached to the inside face of the side panels 21, in an embodiment in which the width of the seat 13 is small enough so as to not overlie the top edge 25 of the chair's side panels 21.

As detailed elsewhere, the three storage features 18, 20, and 24, provide handy storage for various articles used by or for the child.

CONCLUSION

It is thus seen that multi-purpose youth furniture, constructed and used according to the inventive concepts herein set forth, provide novel concepts of a desirable and advantageous device, yielding the advantages of an overall combination of a seat and a variety of special storage regions, which in overall combination is conceptually different from the prior art even though furniture embodying storage regions as a basic concept has of course been known for years; yet significantly this particular combination of prior art has not been suggested by the prior art, this achievement being a substantial and advantageous departure from prior art, even though the prior art shows attempts at improvement and variations as to storage provisions for many years. And particularly is the overall difference from the prior art significant when the non-obviousness is viewed by a consideration of the subject matter as a whole, as integrally incorporating a combination of features as different from the prior art, in contrast to merely those details of novelty themselves, and further in view of the prior art teaching away from the particular and inter-related concepts and features of the present invention.

In summary as to the nature of these advantageous concepts, their inventiveness is shown by novel features of concepts and construction shown here, in novel and advantageous combination, not only being different from all the prior art known, but because the achievement is not what is or has been suggested to those of ordinary skill in the art, especially realistically considering this as comprising components which individually are similar in nature to what is well known to most persons, surely including most of the parents and other child-attendants for many years, the entire world over. No prior art has suggested the modifications of any prior art to achieve the novel concepts here achieved, with the various features providing their own functions in the overall combination.

Accordingly, it will thus be seen from the foregoing description of the invention according to these illustrative embodiments, considered with the accompanying drawings, that the present invention provides a new and useful concepts of a novel and advantageous youth furniture device having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown. Thus, e.g., although the various storage components are shown and described of specific types, they are not necessarily significantly different; for the advantageous combination is achieved by the plurality of storage zones which take advantage of substantially all possible portions of convenient reachability for storage, in contrast to specific dimensions or specific shapes of the various storage zones or regions.

I claim:

1. A multi-purpose chair, comprising, in combination:

a base means;

a seat means;

hinge means pivotally connecting the seat means and the base means;

support means provided by the base means;

the base means having support means providing that the seat means is supported between a generally horizontal seat position for providing a support seat for a person, and an upraised position spaced from the support means;

the base means being provided with a support tray supported by the base means below the seat position of the seat means, and providing article-storage of a first type below the seat means;

the base means provided with a generally upright panel means extending above the seat position of the seat means, providing a supportive back for a person seated on the seat means;

the said panel means being provided with receiver means for providing article-storage of a second type rearwardly on the back of the panel means.

2. The invention as set forth in claim 1, in a combination in which the base means is provided with a drawer providing article-storage of a third type, and the tray is supported by the base means above the drawer.

3. The invention as set forth in claim 1, in a combination in which the receiver means are provided in the form of an upwardly-open pocket means.

4. The invention as set forth in claim 1, in a combination in which the receiver means is provided by a plurality of individual receiver members.

5. The invention as set forth in claim 2, in a combination in which the receiver means is provided by a plurality of individual receiver members.

6. The invention as set forth in claim 3, in a combination in which the receiver means is provided by a plurality of individual receiver members.

* * * * *